United States Patent [19]

Thorud et al.

[11] Patent Number: 4,908,968

[45] Date of Patent: Mar. 20, 1990

[54] SNOWTHROWER WITH RESILIENT IMPELLER

[75] Inventors: Richard A. Thorud, Bloomington; Henry B. Tillotson, Minneapolis, both of Minn.

[73] Assignee: The Toro Company, Minneapolis, Minn.

[21] Appl. No.: 181,786

[22] Filed: Apr. 15, 1988

[51] Int. Cl.[4] ..... E01H 5/09

[52] U.S. Cl. ..... 37/233; 37/244

[58] Field of Search ..... 37/233, 244, 232, 258, 37/259, 262

[56] References Cited

U.S. PATENT DOCUMENTS

| | | | |
|---|---|---|---|
| 1,601,718 | 10/1926 | Buttweiler | 37/233 |
| 3,086,304 | 4/1963 | La Tendresse | 37/232 |
| 3,313,049 | 4/1967 | Blozis | 37/245 |
| 3,359,661 | 12/1967 | Speiser et al. | 37/262 |
| 3,429,060 | 2/1969 | Merry | 37/259 |
| 3,429,061 | 2/1969 | Haban | 37/258 |
| 3,747,240 | 7/1973 | Salo | 37/232 |
| 3,800,448 | 4/1974 | Preston | 37/259 |
| 3,805,421 | 4/1974 | Kamlukin et al. | 37/233 |
| 4,346,526 | 8/1982 | Mattson et al. | 37/259 |
| 4,694,594 | 9/1987 | Thorud et al. | 37/244 |

FOREIGN PATENT DOCUMENTS

| | | | |
|---|---|---|---|
| 581185 | 11/1977 | U.S.S.R. | 37/233 |

OTHER PUBLICATIONS

Brochure entitled "The Toro S-120 Snowthrower", Form No. HID-A010-A.

*Primary Examiner*—Edgar S. Burr
*Assistant Examiner*—Moshe I. Cohen
*Attorney, Agent, or Firm*—R. Lawrence Buckley

[57] ABSTRACT

A snowthrower (10) having an improved impeller (20). Impeller (20) preferably includes a central rotating shaft (34) which fixedly supports at either end thereof an end member (46) and rotatably supports proximate its center a center bracket (48) wherein elements (46) and (48) support one or more one-piece flexible curved paddles (36). In operation, when rotating impeller (20) encounters a foreign object (70), shaft (34) and end members (46) continue to turn while center bracket (48) rotates to some degree on shaft (34) to allow the center sections (38) of paddles (36) to twist and flex relative to shaft (34) and end members (46), thereby permitting center sections (38) of paddles (36) to easily ride up and over obstruction (70). This minimizes the shock associated with impact of the rotating impeller (20) with obstruction (70), and prevents stalling of the prime mover (18) of snowthrower (10).

14 Claims, 4 Drawing Sheets

SNOWTHROWER WITH RESILIENT IMPELLER

TECHNICAL FIELD

The invention pertains generally to snowthrowers. More particularly, the invention concerns the snow-throwing impeller of single stage snowthrowers.

BACKGROUND OF THE INVENTION

Powered snowthrowers are well known and are generally either single stage or two stage. Single stage snowthrowers are so named because they have only one powered implement, namely the impeller, for both picking up and throwing the snow outwardly away from the snowthrower. Two stage snowthrowers, on the other hand, utilize two separate means for consecutively handling the snow, typically an auger for picking up the snow and a high speed fan for throwing the snow away from the snowthrower. Both types of snowthrowers have their own particular advantages and disadvantages. For example, single stage snowthrowers are generally lighter and less expensive than two stage snowthrowers, but they generally do not throw snow as far or control the direction of the thrown snow as well as do two stage snowthrowers.

Mention should also be made of so-called mid-model snowthrowers (e.g., see U.S. Pat. Nos. 4,694,594 and 4,322,896) which might be considered a cross between a single stage and a two stage. Such mid-model snowthrowers typically include opposed auger flights that feed snow to a central snowthrowing section that rotates on the same shaft as the auger flights. Importantly, mid-model snowthrowers are classified herein as single stage snowthrowers, given the fact that they indeed have only one powered implement, albeit a fairly sophisticated multi-purpose implement. The present invention relates primarily to single stage snowthrowers (including mid-model type single stage snowthrowers), and the remainder of this discussion will focus thereon.

A typical single stage snowthrower is illustrated in U.S. Pat. No. 3,359,661 to Speiser. This type of snowthrower includes a housing which is generally open in front having spaced side walls connected by a rear wall that includes an arcuate lower portion. A snowthrowing impeller is rotatably journalled between the side walls to sit in front of the lower portion of the rear wall. The impeller includes a pair of flexible radially extending paddles for picking up and throwing snow. Speiser's paddles, preferably formed from linear polyethylene, are flat and are rigidly mounted along their entire length on a shaft coupled to the snowthrower's prime mover. Elongate reinforcing brackets and threaded fasteners serve to connect the paddles to the shaft. Vanes, mounted at the top of the housing opening, selectively direct the snow thrown by the flat paddles either forwardly or to one side or the other of the snowthrower.

While the Speiser type of snowthrower is generally useful for its intended purpose, the flat paddle/vane combination generally can't throw the snow as far, or control the direction of the thrown snow as well, as a two stage snowthrower. Also, the Speiser snowthrower is susceptible to damage when it encounters an obstruction such as a rock, ice chunk or tree branch. This vulnerability is primarily attributable to the fact that the paddles, although somewhat flexible, are rigidly connected along their entire length to the rotating shaft which in turn is coupled to the prime mover by a drive train, e.g., belts and pulleys. Thus, when a foreign object or obstruction (e.g., large chunk of ice or stick) becomes wedged between the impeller and the rear wall of the housing, the latter sometimes cracks, particularly if it is made from plastic. Moreover, the impact caused by the obstruction is in effect transmitted to the prime mover by the drive train, reducing the prime mover's power, causing stalling, and shortening the useful lives of the prime mover and drive train components.

An improved single stage snowthrower (of the mid-model type) is shown and described in U.S. Pat. No. 4,694,594, to R.A. Thorud et al. The Thorud snowthrower includes a single rotating implement having a pair of opposed auger flights feeding an axially-aligned central snowthrowing section fixedly attached to the same shaft as the auger flights. Attached to the rotating shaft is a pair of opposed metal stampings which sandwich opposing radially extending flexible paddles. The paddles are curved in such a way that the auger flights smoothly blend into the central snowthrowing section. Although the Thorud device is superior to the Speiser type of snowthrower in many respects, including directional control of the thrown snow, the housing of the commercial embodiment of Thorud had to be made very strong and massive to accommodate obstruction impact without cracking. The Thorud housing is most vulnerable when the obstruction is encountered by the central snowthrowing section of the impeller since it tends to strike obstructions squarely in accordance with its more-or-less flat radial configuration. The auger sections are less likely to cause damage, since they tend to strike obstructions obliquely. Also, it was perceived that the Thorud design could or should be improved to achieve weight and cost savings.

A lightweight snowthrower is advantageous in terms of maneuverability and portability. The obstruction impact problem, therefore, is particularly troublesome, as lightweight relatively fragile plastics are frequently utilized to achieve a lightweight snowthrower. Several solutions to the impact problem have been proposed, including using resilient elements between the prime mover and the rotating impeller shaft, and/or using slip clutches or the like. See, for example, U.S. Pat. No. 4,346,526 which discloses use of a torsion bar (resilient element) coupling in a snowthrower, and U.S. Pat. No. 3,313,049 which discloses a slip clutch in the impeller drive train of a snowthrower. Although both proposed solutions are theoretically sound, they add weight, cost, and complexity to the snowthrower. Slip clutches, in particular, are susceptible to slipping at too low a torque or not slipping at all when most needed. Moreover, as discussed above the obstruction impact problem is attributable primarily to the central snowthrowing section of the impeller, and thus it is unnecessary to provide "springiness" or "slip" in the entire impeller, particularly the auger portions.

Only one prior art reference, U.S. Pat. No. 3,086,304 to Tendresse, seems to have recognized that the obstruction impact problem is most closely associated with the central snowthrowing section of an impeller, and that there is no need to provide slip clutches or the like in the impeller drive train. Tendresse discloses a snowthrower with a "self-restoring" impeller. Two end augers, mounted on a rotating shaft, feed snow inwardly to a central "impeller" comprised of a pair of 180° opposed inner portions fixed to the rotating shaft and a pair of outer portions hinged thereto. Springs resist rotation of the outer portions relative to their respective inner portions, so that normally each associated pair of inner and outer impeller portions combine to form a flat snowthrowing paddle, but when an obstruction is encountered the outer portion can pivot against the resistance of the spring.

While Tendresse seems to have recognized the obstruction impact problem discussed above, his proposed solution is inadequate for several reasons. For one thing, the metal impellers, springs, hinges and associated parts make for a massive, complicated assembly. Also, Tendresse's springs and hinges would tend to ice up and become rigid in some circumstances.

The present invention, a resilient impeller for a single stage snowthrower, addresses the obstruction impact problem disclosed above. In addition, the impeller of the present invention provides cost and weight savings as compared to the prior art.

SUMMARY OF THE INVENTION

Accordingly, in broad terms the invention is an improved single stage snowthrower having an impeller which includes (i) first and second axially aligned end members rotatably mounted at opposite ends of the snowthrower's housing opening, the end members being operatively coupled to the snowthrower's prime mover; (ii) a one-piece flexible paddle having a central section and first and second end sections, wherein the first and second end sections are respectively operatively connected to the first and second end members; and (iii) means located between the end members and operatively connected to the central section of the paddle for radially restraining the central section of the paddle against significant distortion caused by centrifugal forces associated with rotation of the impeller, wherein the restraining means can rotate relative to the end members, whereby the central section of the paddle can twist and flex relative to the end members upon encountering a foreign object.

In a preferred embodiment, the improved impeller includes a plurality of one-piece flexible paddles operatively connected to the end members and spanning therebetween.

Preferably, a shaft interconnects the end members and the "restraining means" is rotatably connected to the shaft.

More preferably, there are two opposed flexible paddles and the "restraining means" includes a bracket forming an apertured hub for slideably receiving the impeller shaft; and a pair of opposed flanges extending radially from the hub to the central sections of the paddles.

The paddles are preferably resilient, made at least in part from elastomeric material, for example.

BRIEF DESCRIPTION OF THE DRAWING

The invention will be further described with reference to the appended drawing, wherein.

DETAILED DESCRIPTION OF PREFERRED EMBODIMENT

Figure 1:
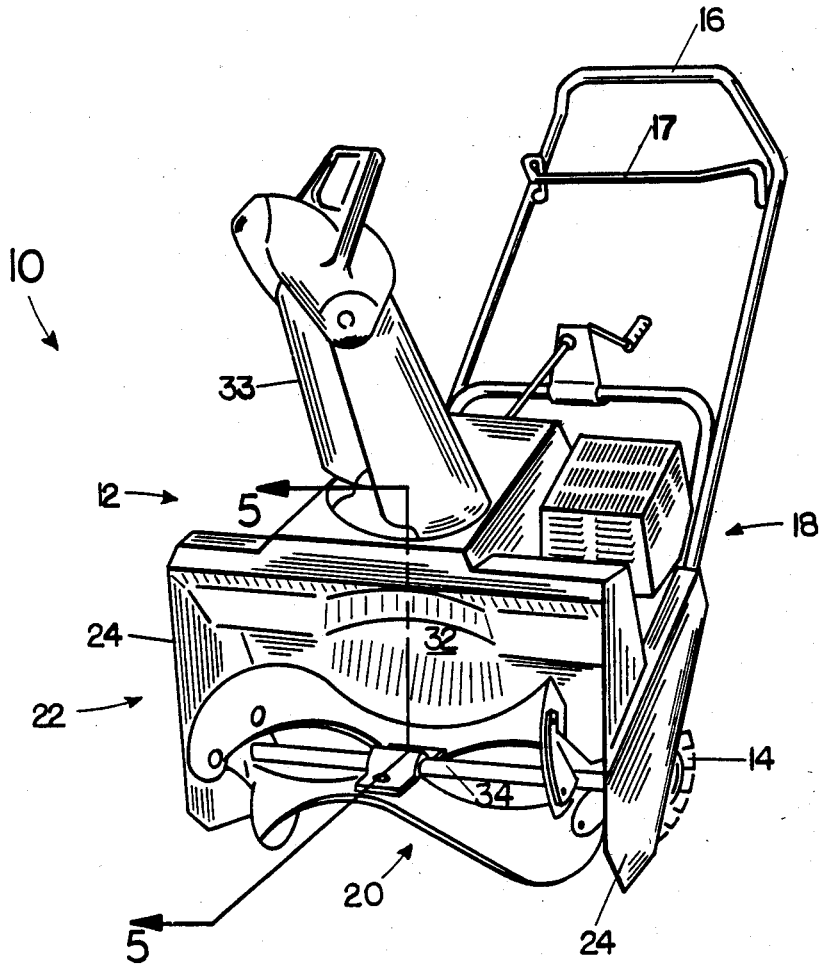
FIG. 1 is a perspective view of a single stage snowthrower according to the present invention.

In the Drawing, wherein like reference numerals designate like parts and assemblies throughout the several views, FIG. 1 shows an improved snowthrower 10 according to the invention. Snowthrower 10, a preferred embodiment of the invention, is generally of the type shown and described in U.S. Pat. No. 4,694,594, to Thorud et al., incorporated herein by reference. It should be noted at the outset that although Thorud et al. and the appended Drawing show a mid-model type single stage snowthrower, the invention is applicable to any single stage snowthrower.

Generally, snowthrower 10 includes a housing 12 supported for rolling along the ground by two spaced apart wheels 14. A U-shaped, upwardly extending handle assembly 16 is secured to the back of housing 12 and terminates at a height above the ground which is convenient for being gripped by an operator. An internal combustion engine 18, or any other suitable prime mover, is mounted atop and behind housing 12 and the output shaft (not shown) of engine 18 is rotatably coupled by belts and pulleys, or any other drive train means, to an impeller 20. Handle assembly 16 carries a pivoting bail 17 which selectively clutches prime mover 18 to impeller 20.

Housing 12 includes an open front portion 22 in which impeller 20 is housed for contacting the snow. Front portion 22 includes two side walls 24 and a rear wall 26 (see FIG. 5). Rear wall 26 includes a lower arcuate portion 28 which is semicylindrical in shape and an upper portion 30 integrally connected to lower portion 28. Front portion 22 of housing 12 also preferably includes an inverted, funnel-shaped collecting chamber 32 located at the middle of the upper portion 30 of rear wall 26, through which the snow picked up by impeller 20 is thrown upwardly and into a chute 33 which adjustably directs the snow forwardly or laterally away from the snowthrower. As the invention is primarily directed to impeller 20, the remainder of this description will focus thereon.

IMPELLER 20

Figure 2:
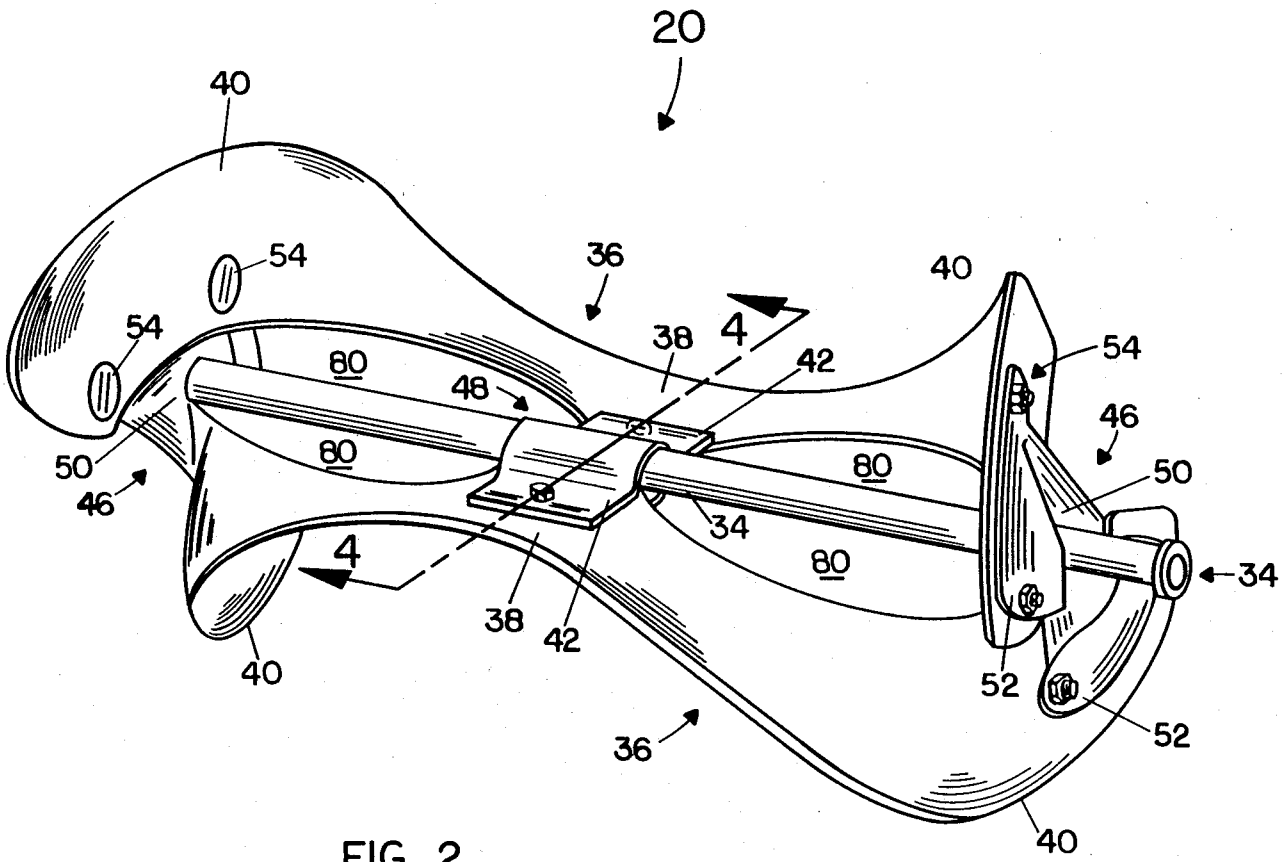
FIG. 2 is a perspective view of the impeller of the snowthrower shown in FIG. 1.

Referring to FIGS. 1 and 2, improved impeller 20 preferably includes a steel shaft 34 spanning between end walls 24 of housing front portion 22 and rotatably journalled therein. One end of shaft 34 can carry a pulley (not shown) around which is reeved a belt which is similarly reeved about a pulley (not shown) connected to the output shaft of prime mover 18. A pivoting idler pulley (not shown) connected to bail 17 can be used to selectively tension the belt to allow torque to be transmitted from the prime mover to impeller shaft 34. Thus, except for slippage of the belt about the pulleys under extremely high torque loadings, the power of prime mover 18 is directly and continuously transmitted to rotating shaft 34 of impeller 20, assuming the impeller clutch (not shown) is engaged. Such a drive train is simple and efficient, but its lack of "give" or "slip" could result in obstruction impact problems but for the design of the improved impeller 20, described in detail below. The drive train (not shown) of snowthrower 10 is enclosed within cover 35 extending from one of the side walls 24 to prime mover 18.

In some respects, impeller 20 is similar to the impeller described in U.S. Pat. No. 4,694,594, incorporated herein by reference. For example, impeller 20 preferably includes two outwardly extending paddles 36, identical in shape, which are offset 180° from each other around the circumference or impeller 20. Moreover, the curved shape of paddles 36 is preferably identical to the curved shape of the paddles described in Thorud. Each paddle 36 includes a relatively long, central snow-throwing section 38 surrounded on either end by a relatively short, end section 40 that functions as an auger. Central section 38 is generally concave in shape between each side thereof. Each end section 40 comprises a relatively small portion of one complete turn of an inwardly directed helical or spiral auger having a relatively small pitch in relation to the length of paddle 36. And, each end section 40 is integrally joined to central section 38 so that it smoothly feeds snow into the central section 38. The preferred proportioning of the various paddle sections relative to one another is also as described in Thorud.

Figure 3:
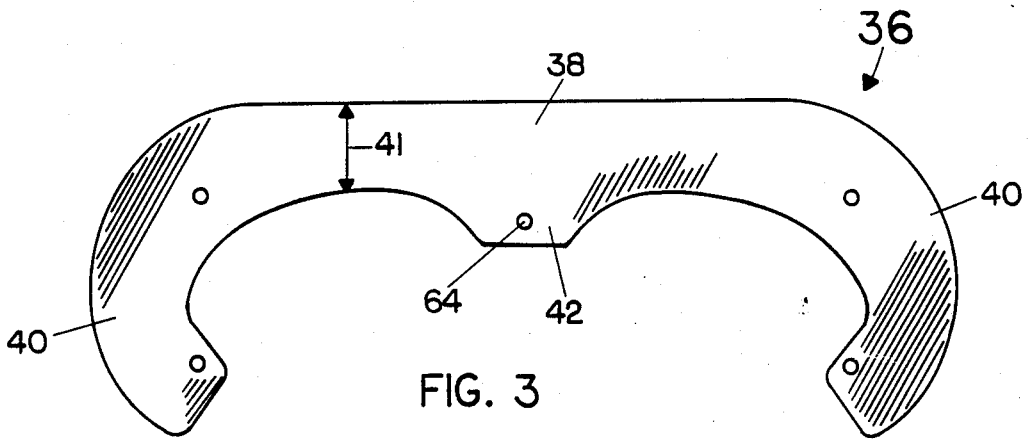
FIG. 3 is a top plan view of a paddle before it is bent and assembled into the shape of the impeller shown in FIG. 2.

Each paddle 36 is preferably made from a single piece of flexible material, such as a fiber reinforced rubber, which may be stamped or cut out of a large piece of stock or molded so as to provide a preformed piece as illustrated in FIG. 3. Each paddle 36 has a fairly consistent width (dimension 41 in FIG. 3) except for a central projection 42 which extends radially inward toward shaft 34 (see FIG. 2). Although any of a wide variety of resilient materials could be used, it has been discovered that a rubber material in the range of about 55 to 65 on the Shore A scale yields a satisfactory paddle 36 according to the invention. Moreover, referring to FIG. 4, it has been discovered that it is also preferred to use one or more layers 44 of a fabric reinforcing material inside the rubber material with the fabric having a tensile strength sufficiently great to prevent the rubber material from stretching excessively. One acceptable material for paddle 36 is rubber conveyor belting manufactured by Uniroyal and known as Uniroyal US Flex C 175 which includes one centered polyester fabric layer covered by two equal thicknesses of SBR rubber. Another acceptable material is Goodyear Plylon 150/2B which includes two layers of polyester fabric. The thickness of the aforementioned Uniroyal or Goodyear material is preferably about 0.2 inch.

Each preformed paddle 36 is bent into the shape illustrated in the Drawing and described herein and maintained in that shape through the use of a pair of end stampings or plates 46 and a center bracket 48. Those skilled in the art will recognize that stampings 46 could be any type of member, such as a disk, spider, plate, or stamping, which functions to connect paddle end sections 40 to shaft 34. The end stampings 46 are preferably made of 12 or 14 gauge steel and are welded or otherwise fixedly secured to shaft 34, toward the ends thereof; whereas center bracket 48, also preferably made of light gauge sheet steel, preferably freely pivots on shaft 34. End stampings 46 are preferably very similar if not identical to the end stampings of Thorud. Thus, each end stamping 46 is shaped to define the auger-like end sections 40 of paddle 36. Each includes a central circular hub 50, preferably welded to shaft 34, and a pair of radially extending ears 52. Each ear 52 is slanted at an oblique angle relative to the axis of shaft 34 to define the inwardly slanted orientation of end section 40 as it functions as an auger. Each end section 40 is secured to an ear 52 by a pair of threaded fasteners 54.

Threaded fasteners 54 are preferably flat-headed machine screws. The flat heads of fasteners 54 are flush with paddles 36 when impeller 20 is assembled and face inwardly toward center bracket 48 so that snow tends to slide over fasteners 54 and they do not hinder the functioning of the auger-like end sections 40 of paddles 36. As described in Thorud, the use of metal stampings 46 and 48 for securing the flexible rubber material of paddle 36 is an economical way of manufacturing impeller 20 and it also allows the paddles to be easily replaced if need be.

Figure 4:
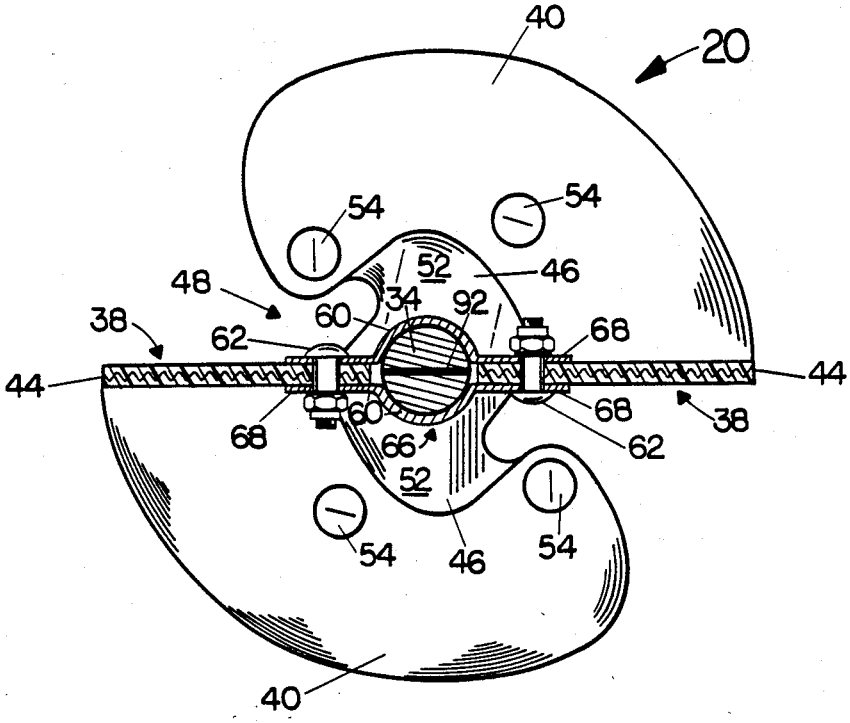
FIG. 4 is a cross-sectional view of the impeller shown in FIG. 2, taken generally along line 4—4 of FIG. 2.

As noted above, center bracket 48 pivotally couples the central section 38, specifically the inward projection 42 thereof, of each paddle 36 to shaft 34. As shown in FIG. 4, center bracket 48 comprises a pair of identical substantially rectangular (in plan view) plates 60 which bolt together using threaded fasteners 62 to grip projections 42 of paddles 36, fasteners 62 passing through apertures 64 in projection 42 (see FIG. 3). Plates 60 form a central generally circular hub portion 66 and a pair of opposed flanges 68 extending radially therefrom, wherein flanges 68 are apertured to receive fasteners 62. Projections 42 are firmly sandwiched and gripped by bracket 48, primarily due to the frictional interaction between flanges 68 and projections 42.

Figure 5:
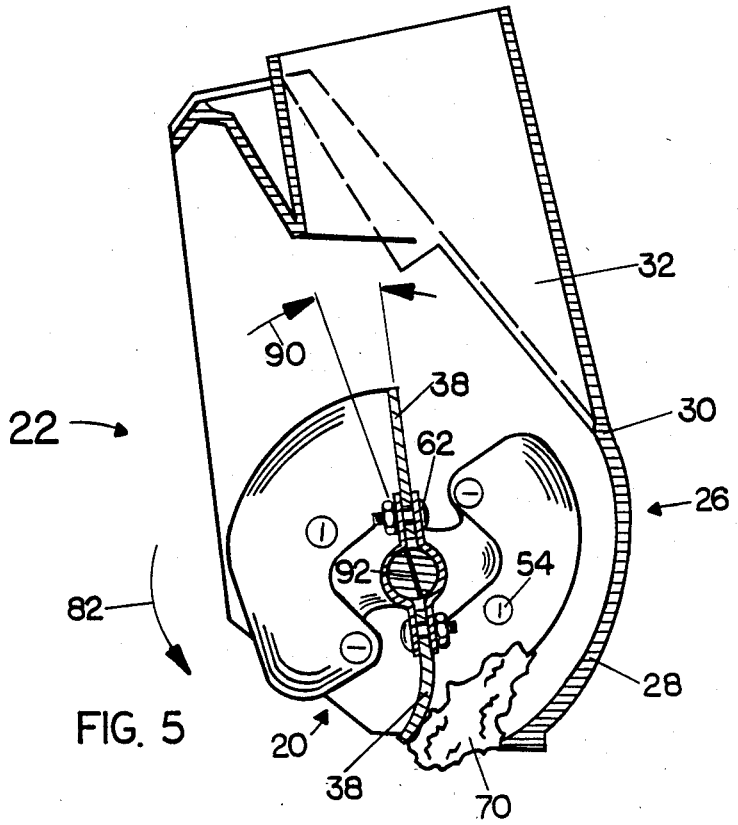
FIG. 5 is a sectional view of the housing and impeller of the snowthrower shown in FIG. 1, taken generally along line 5-5 thereof with an obstruction wedged between the impeller and housing.

It should be emphasized that center bracket 48 is not rotationally secured to shaft 34, hub 66 being sized to permit free rotation of bracket 48 on shaft 34. Thus, when one of the paddles 36 strikes a foreign object 70 such as illustrated in FIG. 5, the central sections 38 of paddles 36 can twist or rotate relative to the end sections 40 thereof so that the shock associated with the impact of the impeller with the foreign object is minimized. In contrast, the long central stamping of the Thorud impeller is fixedly secured to the impeller shaft so that the center sections of the Thorud paddles cannot yield or deflect nearly as much as those of the improved impeller 20 described herein.

It should also be noted that center bracket 48 primarily functions to prevent the relatively thin and "floppy" paddles 36 from deflecting too much in the radial direction, away from shaft 34, during high speed rotation of impeller 20 due to centrifugal force. Those skilled in the art will therefore recognize that alternatives to center bracket 48 could be used, including but not limited to individual wires or springs running from paddle center sections 38 to shaft 34, so that paddle center sections 38 are not interconnected. Or, paddle center sections 38 could be tied together in some fashion by a device other than bracket 48.

Another significant difference between impeller 20 and some prior art impellers, including Thorud, is that impeller 20 forms four open spaces 80 between center bracket 48 and end brackets 46. Each open space 80 is in the nature of a circular segment, with shaft 34 linearly bounding the space and the curved inner edge of the paddle 36 forming a three-dimensional curvilinear boundary for the space. In a preferred embodiment, dimension 41 is about 1.9 inch whereas the radius of impeller is about 3 inches; therefore, each space 80 is about 1.1 inch at its widest point. Experimentation has shown that open spaces 80 do not detrimentally affect the snowthrowing ability of impeller 20 and provide it with the appropriate amount of "give" when encountering a foreign object 70 such as shown in FIG. 5.

OPERATION

In operation, a pull rope or electric starter (not shown) is used to start engine 18 of snowthrower 10. Operation of impeller 20 can begin at any time simply by closing bail 17 against handle assembly 16. This transfers power from engine 18 to impeller 20 to rotate impeller 20 in the direction of arrow 82 in FIG. 5. The operator can then use rotation of impeller 20 to help move snowthrower 10 along the ground. This is done by slightly tipping snowthrower 10 forwardly to bring rubber paddles 36 into engagement with the ground. The central sections 38 of paddles 36 resist twist sufficiently to allow the snowthrower to be self-propelled. The "spring constant" of central sections 38 in twist is not readily determined and can vary greatly depending on the resiliency and shape of paddles 36 and the degree to which the paddles 36 are deformed in their normal state (i.e., as shown in FIG. 4). While difficult to quantify, the "twisting rigidity" or "spring constant" of paddles 36 can be qualitatively adjusted in many ways. For example, the paddles can be made more rigid by increasing the width of center bracket 48 and projections 42 along the axis of shaft 34.

Under normal conditions, auger sections 40 move snow inwardly toward central sections 38 of paddles 36 which in turn throw the snow upward through collecting chamber 32 and chute 33 and away from snowthrower 10. If, on the other hand, as shown in FIG. 5, a large chunk of ice or other foreign object 70 is encountered, the central sections 38 of paddles 36 can deform and the entire bracket 48 can twist on shaft 34 to allow impeller 20 to continue turning in spite of the impact, and without damaging housing 22. Thus, central sections 38 merely ride up and over obstruction 70 until the obstruction is thrown through chute 33 or falls out of the housing. Also, engine 18 doesn't stall and the entire impeller drive system avoids the mechanical shock which would have occurred had the central sections 38 been rigidly connected to shaft 34.

The twisting of center bracket 48 upon encountering a foreign object 70 is illustrated by angle 90 in FIG. 5. FIG. 4 shows a sectional view of impeller 20 taken generally through line 4—4 of FIG. 2 when impeller 20 is in its undisturbed or normal state. In this condition, an imaginary datum line 92 on shaft 34 passes substantially through the center of each paddle 36 (substantially through polyester layer 44). However, when an obstruction 70 is encountered shaft 34 and end plates 46 will continue to turn while the center bracket 48 twists, thus resulting in angle 90 of bracket 48 relative to datum line 92 on shaft 34.

Of course, the twisting of center bracket 48 results somewhat in a distortion of paddles 36 from their normal "round" (on end view) configuration, such as shown in FIG. 4. The degree and particular embodiment of this distortion will depend on the nature and size of the obstruction, but FIG. 5 generally illustrates how paddles 36 will tend to go "out-of-round" in this situation. Also, as discussed above the precise number of degrees of angle 90 is difficult to predict, since it depends on the obstruction and the precise shape and resiliency of paddles 36, and even to some degree the rotational speed of impeller 20. However, it is thought that center bracket 48 will twist between about 20 and 35 degrees (angle 90, FIG. 5) when snowthrower 10 encounters a fairly sizable obstruction such as ice chunk 70 shown in FIG. 5, at least when impeller 20 is configured as described herein.

Impeller 20 is resilient and will tend to return to its "normal" state after each central section 38 rides up and over obstruction 70. In other words, center bracket 48 will repeatedly twist in one direction and then the other as paddles 36 alternately impact the obstruction and snap back into their normal positions.

There are other modifications which will be apparent to those skilled in the art. Accordingly, the scope of this invention will be limited only by the appended claims.

We claim:

1. An improved single stage snowthrower of the type having a housing forming an opening, a shaft extending across said opening a rotatable snowthrowing impeller mounted on a shaft within the housing opening, and a prime mover operatively connected to the impeller, wherein the impeller comprises:

(a) first and second axially aligned end members mounted for rotation with said shaft at opposite ends of the housing opening, the end members being operatively coupled to the prime mover;

(b) a flexible elastomeric paddle comprising a central section operatively connected to first and second end sections, the first and second end sections being respectively operatively connected to the first and second end members; and (c) means located between the end members and operatively connected to the central section of the paddle for radially restraining the central section of the paddle against significant distortion caused by centrifugal forces associated with rotation of the impeller, the restraining means being freely rotatable relative to the shaft and the end members, so that when the impeller is rotated by the prime mover and the central section encounters an obstruction the restraining means can rotate relative to the shaft and the end members and the central section can twist and flex relative to the paddle end sections to accommodate the obstruction, and subsequently the resilience of the paddle returns the paddle central section and the restraining means to their normal positions relative to the paddle end sections and the end members, respectively.

2. An improved single stage snowthrower of the type having a housing forming an opening, a shaft extending around said opening a rotatable snowthrowing impeller mounted on said sheet within the housing opening, and a prime mover operatively connected to the impeller, wherein the impeller comprises:

(a) first and second axially aligned end members mounted for rotation with the shaft at opposite ends of the housing opening, the end members being operatively coupled to the prime mover;

(b) a plurality of flexible elastomeric paddles each comprising a central section and operatively connected to first and second end sections, wherein the first and second end sections are respectively connected to the first and second end members; and (c) means located between the end members and operatively connected to the paddles for radially restraining the central sections of the paddles against significant distortion caused by centrifugal forces associated with rotation of the impeller, the restraining means being freely rotatable relative to the end members, such that when the impeller is rotated by the prime mover and the central sections encounter an obstruction the restraining means can rotate relative to the end members and the central sections can twist and flex relative to their respective end sections to accommodate the obstruction, and subsequently the resilience of the paddles returns the paddle central sections and the restraining means to their normal positions relative to the corresponding paddle end sections and the end members, respectively.

3. The snowthrower of claim 2, further comprising a shaft interconnecting the end members, wherein the restraining means is rotatably connected to the shaft.

4. The snowthrower of claim 3, wherein the restraining means comprises:

(a) a bracket forming an apertured hub for slidably receiving the shaft; and (b) a pair of opposed flanges extending radially from the hub to the central sections of the paddles.

5. The snowthrower of claim 4, wherein the radial dimension of each paddle between the central section and the end sections thereof is substantially less than the total radial dimension of the entire impeller, whereby the impeller is substantially open proximate the shaft between the paddle central sections and the paddle end sections.

6. The snowthrower of claim 2, wherein each paddle comprises a single piece of conveyor belt material having elastomeric and fabric reinforcing layers.

7. The snowthrower of claim 6, wherein the central section of each paddle comprises a projection extending radially inwardly to the restraining means.

8. The single stage snowthrower of claim 2, wherein the elastomeric paddles comprise a rubber material.

9. The single stage snowthrower of claim 14, wherein the paddles further comprise a fabric reinforcing layer.

10. An improved single stage snowthrower of the type having a housing forming an opening, a rotatable snowthrowing impeller mounted within the housing opening, and a prime mover operatively connected to the impeller, wherein the impeller comprises:

(a) a shaft rotatably journalled within the housing opening and operatively coupled to the prime mover;

(b) first and second end members fixedly connected to the shaft proximate the ends thereof;

(c) a pair of resilient elastomeric paddles each comprising a generally concave central snowthrowing section and first and second auger sections connected to either side thereof, wherein the first and second auger sections are respectively fixedly connected to the first and second end members; and (d) a center brack forming a hub rotatably receiving the shaft for rotation relative to the shaft and comprising a pair of opposed flanges which extend radially from the hub to engage the central sections of the paddles, such that when the impeller is rotated by the prime mover and the central snowthrowing sections encounter an obstruction the center bracket can rotate relative to the end members and the central sections can twist and flex relative to their respective end sections to accommodate the obstruction, and subsequently the resilience of the paddles returns the paddle central sections and the center bracket to their normal positions relative to the corresponding paddle end sections and the end members, respectively.

11. The snowthrower of claim 10, wherein the radial dimension of each paddle between the central section and the end sections thereof is substantially less than the total radial dimension of the entire impeller, whereby the impeller is substantially open proximate the shaft between the paddle central sections and the paddle end sections.

12. An improved single stage showthrower of the type having a housing forming an opening, a shaft extending across that opening a rotatable snowthrowing impeller mounted on said shaft within the housing opening, and a prime mover operatively connected to the impeller, wherein the impeller comprises:

(a) first and second axially aligned end members mounted for rotation with said shaft at opposite ends of the housing opening, the end members being operatively coupled to the prime mover;

(b) a plurality of flexible rubber paddles each comprising a central section operatively connected to first and second end sections, wherein the first and second end sections are respectively connected to the first and second end members; and (c) means located between the end members and operatively connected to the paddles for radially restraining the central sections of the paddles against significant distortion caused by centrifugal forces associated with rotation of the impeller, the restraining means being freely rotatable relative to the end members, such that when the impeller is rotated by the prime mover and the central sections encounter an obstruction the restraining means can rotate relative to the end members and the central sections can twist and flex relative to their respective end sections to accommodate the obstruction, and subsequently the resilience of the paddles returns the central sections and restraining means to their normal positions relative to the end sections and end members, respectively.

13. The snowthrower of claim 12, wherein each paddle comprises a single piece of conveyor belt material having elastomeric and fabric reinforcing layers.

14. A rotatable impeller for a single stage snowthrower, comprising:

(a) shaft means for defining an axis of rotation;

(b) a rubber paddle comprising a central section and first and second end sections;

(c) means for rotationally securing the first and second paddle end sections to the shaft means for rotation with said shaft; and (d) means for radially restraining the paddle central section such that the central section can twist relative to the end sections and such that the central section is constrained against significant outward radial movement relative to the impeller axis of rotation, the restraining means being freely rotatable relative to the shaft and the end sections .

* * * * *